United States Patent [19]

Masaki et al.

[11] 4,297,867

[45] Nov. 3, 1981

[54] PIPE END EXPANDING OR CONTRACTING PROCESS UTILIZING IRONING

[75] Inventors: Masaru Masaki, Aichi; Yoshinori Ito; Akihiko Inoue, both of Toyota; Munetaka Toda, Kariya, all of Japan

[73] Assignee: Toyota Jidosha Kogyo Kabushiki Kaisha, Toyota, Japan

[21] Appl. No.: 53,524

[22] Filed: Jun. 29, 1979

[30] Foreign Application Priority Data

Nov. 15, 1978 [JP] Japan ..... 53-140608

[51] Int. Cl.[3] ..... B21D 22/00

[52] U.S. Cl. ..... 72/347; 72/370

[58] Field of Search ..... 72/354, 356, 370, 347, 72/348

[56] References Cited

U.S. PATENT DOCUMENTS

| | | | |
|---|---|---|---|
| 983,849 | 2/1911 | Wales | 72/370 |
| 1,000,122 | 4/1911 | Reynolds | 72/370 X |
| 1,059,354 | 4/1913 | Ehrardt | 72/370 |
| 1,283,692 | 11/1918 | Debendetti | 72/370 X |
| 1,647,447 | 11/1927 | Hartnett | 72/370 |
| 2,391,766 | 12/1945 | Barnhart | 72/370 |
| 3,566,662 | 3/1971 | Champoux | 72/370 |
| 3,738,146 | 6/1973 | Gunn | 72/370 |
| 4,134,287 | 1/1979 | Muede et al. | 72/370 |

*Primary Examiner*—Leon Gilden

*Attorney, Agent, or Firm*—Stevens, Davis, Miller & Mosher

[57] ABSTRACT

A process and a device for expanding or contracting the end of a pipe are disclosed. First an ironing die or punch is put over or into the end of the pipe. Then the end of the pipe is expanded or contracted by a rod form expanding punch or a tube form reducing die. Then, with this punch or die still in place, the ironing die or punch is pulled over or through the end of the pipe, so as to pinch the wall of the pipe between itself and the punch or die, and thereby the wall of the pipe is ironed so as to release any strains that may have been caused in it by the expanding or contracting process. Thereby more accurate pipe ends can be formed simply and reliably.

7 Claims, 10 Drawing Figures

PIPE END EXPANDING OR CONTRACTING PROCESS UTILIZING IRONING

BACKGROUND OF THE INVENTION

The present invention relates to a method of and a device for processing the end of a pipe so as to form either a reduced or an expanded terminal portion. Particularly, this method or device is suited to a metal pipe, in which there is a danger of stresses being set up during the process, and of springing back of the end after processing.

Up until now, pipe end processing—that is, providing a reduced or an expanded terminal portion on a pipe—has been performed by applying a diameter changing element, like an expanding punch or a reducing die, to the end of the pipe. However, a problem has arisen, in that after this diameter changing element has been applied to the end of the pipe, and thereby the diameter of the end portion of the pipe has been modified, when the diameter changing element has been withdrawn from the end of the pipe, the elasticity of the material of the pipe has caused a spring-back effect, so that the diameter-changed end of the pipe has altered in size and form. Thus, an expanded end of a pipe has finally turned out to be smaller than desired, and a reduced end of a pipe has finally turned out to be larger than desired. Further, sometimes stresses have been set up in the diameter-changed end, due to cracks in the material thereof, and the like, and since these stresses are not properly relieved irregularities of the form of the pipe end often occur. For all these reasons, accurately formed pipe ends have not been properly formed, up till now.

SUMMARY OF THE INVENTION

In view of these problems, it is an object of the present invention to provide a process whereby pipe ends of both reduced and enlarged diameters can be formed accurately and easily.

It is a further object of the present invention to provide a device which by practicing this method can be used to form pipe ends of reduced and enlarged diameters accurately, reliably, and cheaply.

In accordance with the present invention, this first mentioned object is accomplished by a process for altering the diameter of the end portion of a cylindrical pipe which has a cylindrical inside surface and a cylindrical outside surface, comprising the steps, in the specified order, of: (a) applying the cylindrical surface of a diameter modification element to the end of one said cylindrical surface of the pipe, so as to modify the diameter thereof; and (b) squeezing said diameter-modified end of the pipe between said cylindrical surface of said diameter modification element, which is maintained in place as at the end of step (a), and an ironing element which is applied to the other said cylindrical surface of the pipe, and which moves over said diameter-modified end with a clearance between itself and said cylindrical surface of said diameter modification element which is less than the thickness of said diameter-modified end, between its two cylindrical surfaces.

In accordance with the present invention, this second mentioned object is accomplished by a pipe end processing device, comprising a cylinder-piston device, a diameter modification element having a cylindrical surface, and an ironing element, wherein the cylinder-piston device comprises two pistons arranged coaxially, one of which reciprocatingly drives the diameter modification element by fluid pressure being applied to its one end or its other end, and the other of which reciprocatingly drives the ironing element by fluid pressure being applied to its one end or its other end.

BRIEF DESCRIPTION OF THE DRAWINGS

The present invention will now be explained in detail, with reference to some preferred embodiments thereof, and with reference to the accompanying drawings. It must be clearly understood, however, that the description of the embodiments, and the drawings, are given for the purposes of illustration only, in order to make the concept of the present invention more clear, and these are not to be taken as limiting the scope of the present invention in any way; this scope is intended to be defined solely by the accompanying claims, which are appended. In the drawings:

DESCRIPTION OF THE PREFERRED EMBODIMENTS

Figure 1:
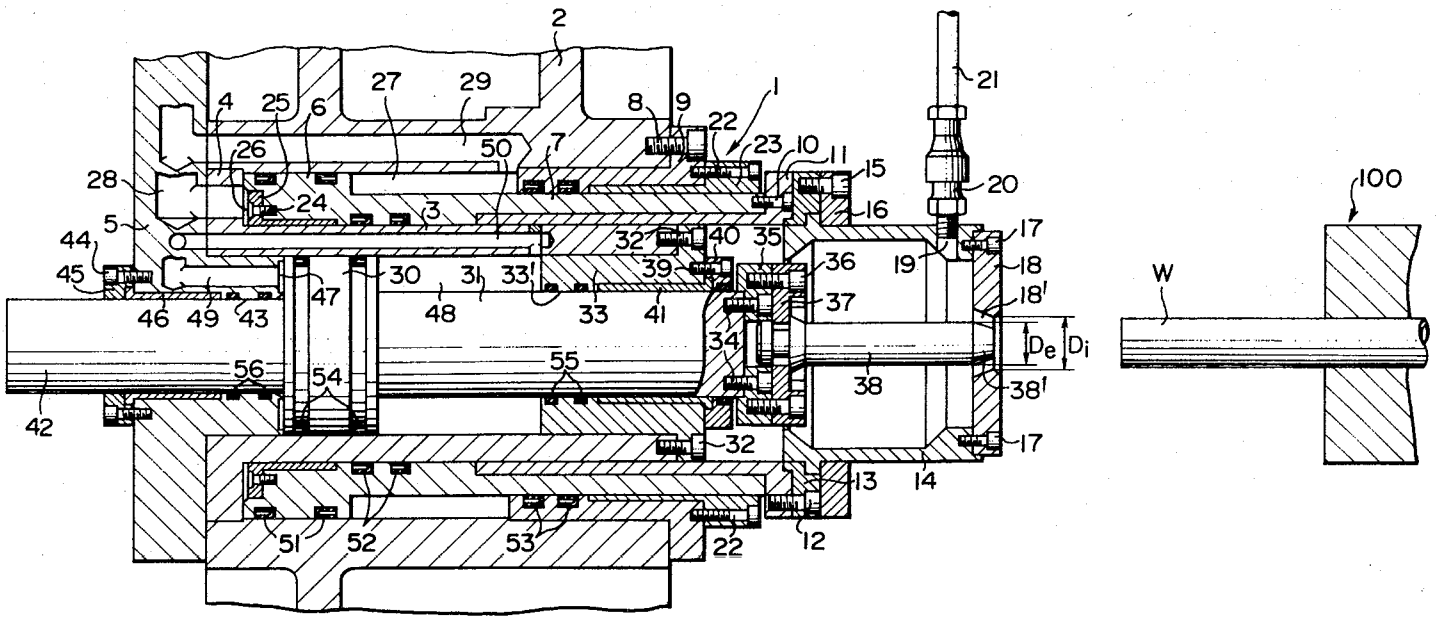
FIG. 1 is a longitudinal section through an embodiment of a processing device for expanding the end of a pipe, according to the present invention.

Referring first to FIG. 1, which shows an embodiment of the device of the present invention, for forming an expanded end in a pipe, according to the method of the present invention, the reference numeral 1 designates a cylinder-piston device for operating the machine, and 100 designates a clamp device for holding the pipe W to be worked on, in its free condition; these are both fixed to a base frame of the device, which is not shown in the figures.

The cylinder-piston device 1 is provided with a first cylinder portion 2, within the bore of which is arranged concentrically a second cylinder portion 3. One axial end of the first cylinder portion 2 is closed by an end flange 4 provided at one axial end of the second cylinder portion 3. This same axial end of the second cylinder portion 3 is closed by an end plate 5, and, by this end plate 5, the first cylinder portion 2 and the second cylinder portion 3 are fixed together. Thus between the first cylinder portion 2 and the second cylinder portion 3 is formed a cylindrical gap. In this cylinder gap is located a first piston member 6, which is free to move to and fro in the left and right directions as seen in the figure.

The first piston member 6 is formed integrally with a tubular first piston rod 7, which extends axially from the first piston member 6 in the direction away from the end plate 5, that is, in the right hand direction as seen in the figure. This first piston rod 7 projects to the right in the figure out beyond the ends of the first cylinder portion 2 and the second cylinder portion 3, and the space between the first piston rod 7 and the first cylinder portion 2 is filled by an end sleeve 9, which is fixed to the first cylinder portion 2 by a plurality of bolts 8 so as to close the right hand end of the aforementioned cylindrical gap. A flanged sleeve 11, which has a cylindrical portion extending some way to the left in the figure inside the first piston rod 7, is fixed to the projecting or right hand end of the first piston rod 7 by a plurality of bolts 10.

Figure 3:
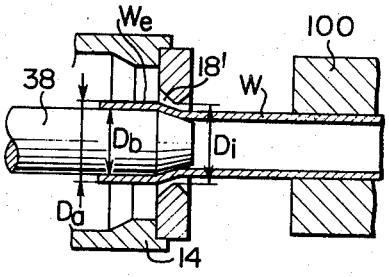

A tubular tool fixing element 14 is held between a fixing ring 13, which is attached to the right hand of the flanged sleeve 11 by a plurality of bolts 12, and a retaining ring 16, which is in turn fixed to the right hand end of the fixing ring 13 by a plurality of bolts 15. In the illustrated embodiment, the tool fixing element 14 supports an ironing die 18, which is fixed to it by screws 17. This ironing die 18 has a tapered die aperture 18', and the diameter Di of the ironing die 18 is formed so as to be about 0.1 to 0.2 mm smaller than the outer diameter Da (as seen in FIG. 3) of the expanded portion We of the work pipe W. The tool fixing element 14 is provided with a supply of working oil through the working oil supply aperture 19, and a working oil supply hose 21 is directly connected to this aperture 19 by a nipple 20. A guide bush 23 is attached to the right hand end of the end sleeve 9 by a plurality of bolts 22, in order to guide the movement of the first piston rod 7, and to ensure that no sidewise play may occur during its movement.

On its left hand end as seen in the figure the first piston member 6 is provided with a bush 25, which is fixed to it by a plurality of bolts 24. This first piston member 6 defines two working pressure chambers: a first pressure chamber 26 between the left end of the first piston member 6 in the figure, (or the bush 25 fixed thereto), the second cylinder portion 3, and the end flange 4; and a second pressure chamber 27 between the right hand end of the first piston member 6 as seen in the figure (where it is formed integrally with the first piston rod 7), the first cylinder portion 2, the first piston rod 7, and the left hand end of the end sleeve 9. Hydraulic fluid may be selectively supplied to the first pressure chamber 26 through a hydraulic fluid passage 28, so that when hydraulic fluid is supplied to this first pressure chamber 26 the first piston member 6 is driven to the right in the figure, along with the first piston rod 7. Further, hydraulic fluid may be selectively supplied to the second pressure chamber 27, through a hydraulic fluid passage 29, so that when hydraulic fluid is supplied to this second pressure chamber 27 the first piston member 6 is driven to the left in the figure, along with the first piston rod 7.

Within the bore of the second cylinder portion 3 is provided a second piston member 30 of cylindrical form, which can move to and fro from left to right in the figure. This second piston member 30 is provided with a rod shaped piston rod 31 extending axially to the right hand side in the figure, and this second piston rod 31 extends out past the right hand end of the second cylinder portion 3, passing through the hole 33' in the end sleeve 33, which closes the right hand end in the figure of the bore of the second cylinder portion 3, and which is attached to the second cylinder portion 3 by a plurality of bolts 32.

A fitting ring 35 is fixed by bolts 34 to the projecting end of the piston rod 31, and in turn a retaining ring 37 is fixed by bolts 36 to this fitting ring 35. By means of the fitting ring 35 and the retaining ring 37, a rod shaped pipe expanding punch 38 is fitted on the right hand end of the piston rod 31, in such a way that it is coaxial with the ironing die 18, and is able to pass through it when moved rightwards in the figure.

This pipe expanding punch 38 is provided with a tapered portion 38' at its tip, and this punch has a diameter De which is the same as the desired inner diameter Db of the expanded portion of the work pipe W which is to be formed (see FIG. 3).

Furthermore, a guide bush 41 is fitted to the end sleeve 33 by bolts 39 and a retaining ring 40, in order to guide the movement of the piston rod 31 and prevent any sidewise play therein, when it is extended.

The second piston member 30 is also provided with a rod shaped third piston rod 42 extending from its other end, leftwards in the figure, along its axis, and this third piston rod 42 projects leftwards beyond the end plate 5 through a hole 43 provided therein. There is further provided a guide sleeve 46 fitted to the end plate 5 by bolts 44 and a retaining ring 45.

The second piston member 30 defines a third pressure chamber 47 in the space to its left in the figure, between itself and the end plate 5, and a fourth pressure chamber 48 in the space to its right in the figure, between itself and the end sleeve 33. Hydraulic fluid can be selectively supplied to the third pressure chamber 47 through a hydraulic fluid passage 49, and, when hydraulic fluid is thus supplied to this third pressure chamber 47, the second piston member 30 is driven to the right in the figure. Again, hydralic fluid can be selectively supplied to the fourth pressure chamber 48 through a hydraulic fluid passage 50, and when hydraulic fluid is thus supplied to this fourth pressure chamber 48 the second piston member 30 is driven to the left in the figure.

The numerals 51 to 56 inclusive in the figure designate hydraulic fluid seals.

Next, the process involved in performing pipe end processing according to the present invention, using the pipe end processing device shown in FIG. 1, will be explained with reference to FIGS. 2 to 5.

First the first piston member 6 and the second piston member 30 of the cylinder-piston device 1 are withdrawn to the left in the figure, to the positions shown in FIG. 1, by supply of hydraulic fluid to the second pressure chamber 27 through the hydraulic fluid passage 29, and by supply of hydraulic fluid to the fourth pressure chamber 48 through the hydraulic fluid passage 50, respectively.

Then the work tube W which is to be processed is fitted to the clamp device 100, and the axis of this work tube W is set in alignment with the ironing die 18 and the pipe expanding punch 38. When this setting is completed, the device is ready to be operated.

Figure 2:
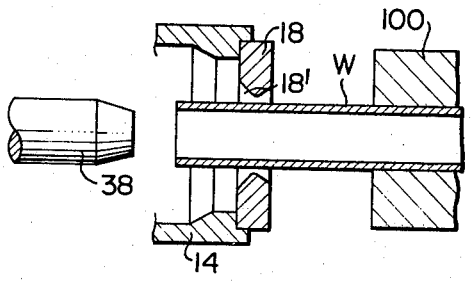
FIGS. 2 to 5 are longitudinal sections showing the various stages of the process of forming an enlarged end on a pipe, according to the method of the present invention, using the device of FIG. 1.

Then hydraulic fluid under pressure is supplied to the first pressure chamber 26 through the hydraulic fluid passage 28, and thereby the first piston member 6 is driven to the right in the figure. Thus the apparatus moves to the state which is shown in FIG. 2, so that the ironing die 18 is placed over the end of the work tube W a certain distance along it, towards the clamped root portion, and is positioned at a point corresponding to or to the right of the part which is required to be expanded. This is possible because the inner diameter of the ironing die 18 at its narrowest portion, Di, is arranged to be somewhat larger than the outer diameter of the work tube W in its original condition.

Next, hydraulic fluid under pressure is supplied to the third pressure chamber 47 through the hydraulic fluid passage 49, the supply of hydraulic fluid under pressure to the first pressure chamber 26 through the hydraulic fluid passage 28 having been previously stopped. Thereby, the second piston member 30 is driven to the right in the diagram, and, as shown in FIG. 3, the pipe expanding punch 38 enters the work tube W from its end and expands it as it moves in, so that an expanded portion We is formed at the end of the work tube W.

When the pipe expanding punch 38 has been inserted to the desired amount, the supply of hydraulic fluid to the third pressure chamber 47 through the hydraulic fluid passage 49 is stopped, and, with the pipe expanding punch 38 held as it is, in the operating position as shown in FIG. 3, hydraulic fluid is introduced into the second pressure chamber 27 through the hydraulic fluid passage 29. Thus the first piston member 6 is withdrawn to the left in the diagram, and as this happens the ironing die 18 is moved leftwards from the end of the expanded portion We of the work tube W in the direction of the open end of the work tube W. As it so moves, this ironing die 18 engages with the outer surface of the expanded portion We of the work tube W and performs an ironing operation, because the inner diameter Di of the ironing die 18 is slightly smaller than the external diameter of the expanded portion, as stated previously. That is, the ironing die 18 squeezes down the expanded portion and relieves the stresses in it, and any spring-back effect that may exist therein, by a process of plastic deformation, against the pipe expanding punch 38.

Figure 4:
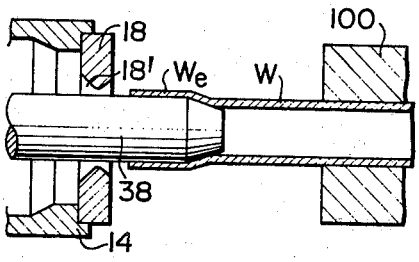
Figure 5:
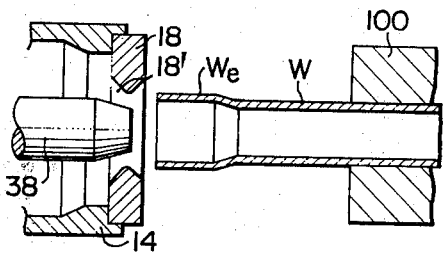

Thus the apparatus comes to be in the position shown in FIG. 4, wherein the ironing die 18 is withdrawn completely from the work tube W, and thus the ironing operation has been completed. Then the supply of hydraulic fluid to the second pressure chamber 27 through the hydraulic fluid passage 29 is stopped, and then hydraulic fluid is supplied to the fourth pressure chamber 48 through the hydraulic fluid passage 50, and thus the second piston member 30 is withdrawn to the left in the diagram. Thus the pipe expanding punch 38, which is currently inside the expanded end of the work tube W, is completely withdrawn from the work tube W. This state is shown in FIG. 5.

Thus a work tube W with an expanded portion We is produced. In this way, after the pipe expanding punch 38 has completely formed the enlarged portion, with the expanding punch held as it is, inside the enlarged portion, the outside of this enlarged portion is ironed by the ironing die, against this expanding punch, and thus all stresses which have been set up in this enlarged portion, and any spring-back effect that may exist therein, are relieved, by a process of plastic deformation. By this process, expanded ends can be formed on pipes in a very high precision manner, because their dimensions can be precisely prescribed by the expanding pipe punch 38 and the ironing die 18, and the pipe end do not alter in shape or size after these tools are removed from them.

Figure 6:
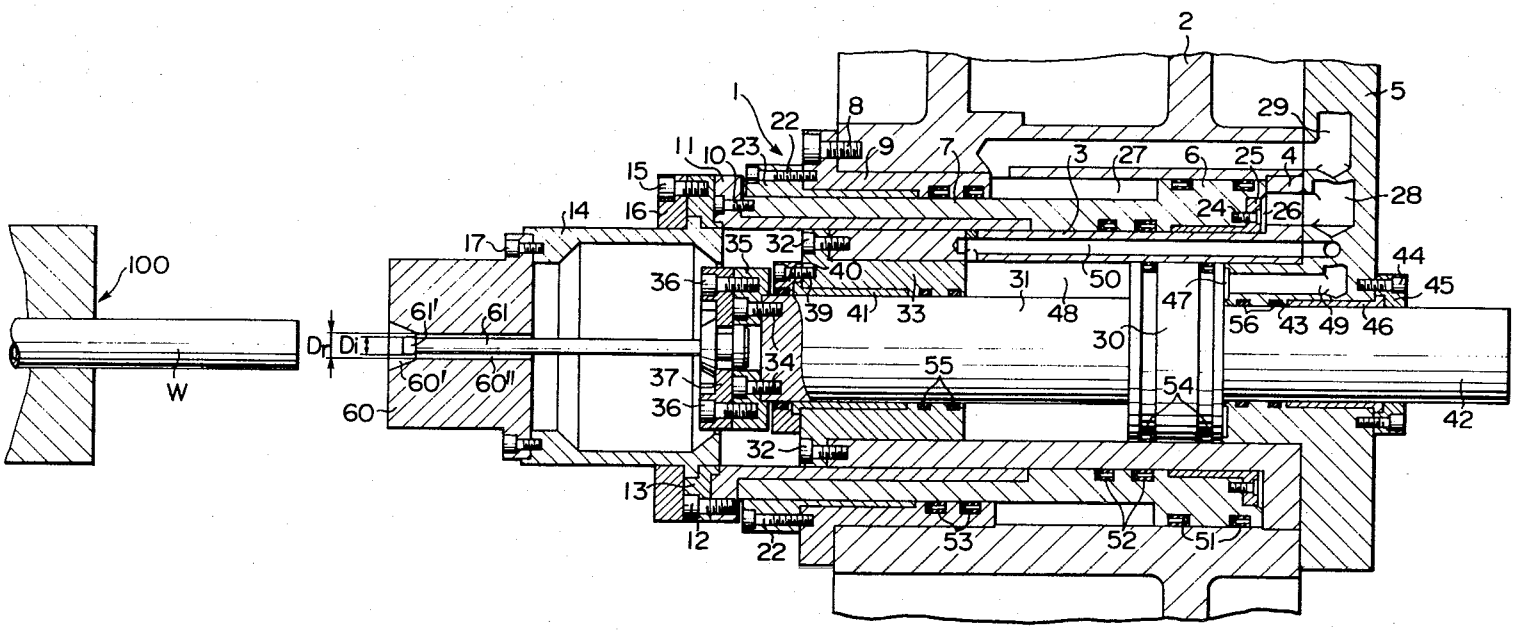
FIG. 6 is a longitudinal section through an embodiment of a processing device for contracting the end of a pipe, according to the present invention.
Figure 8:
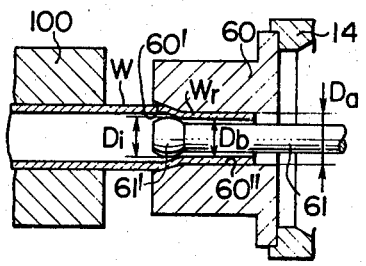

FIG. 6 is a longitudinal sectional view showing one embodiment of a pipe end processing device for pipe end reducing operations. Portions in FIG. 6 which correspond to similar portions in FIG. 1 are designated by the same reference numerals. This pipe end processing device, like the one shown in FIG. 1, is made of a cylinder piston device 1 for performing the working movements, and a clamp device 100 for supporting a work tube W in a fixed position, in a detachable manner. Both of these devices are of substantially the same construction as the corresponding devices in the embodiment shown in FIG. 1. In this case, however, the tool fixing element 14 of the cylinder piston device 1 holds a reducing die 60 fixedly by means of screws 17, and the second piston member 31 holds an ironing punch 61 fixedly. The reducing die 60 has a tapered entrance hole 60′ and a cylindrical bore 60″. The die diameter Dr of its narrower portion is the size that is required for the reduced portion of the pipe end W, which in FIG. 8 is designated as Da. The ironing punch 61 is provided with a substantially spherical ironing end portion 61′ formed at its tip, and this portion 61′ for ironing work has an outside diameter Di, which is arranged to be 0.1 to 0.2 mm more than the inner diameter Db of the reduced portion Wr of the work tube W, and which is the size required for the final inner diameter of this reduced portion.

Figure 7:
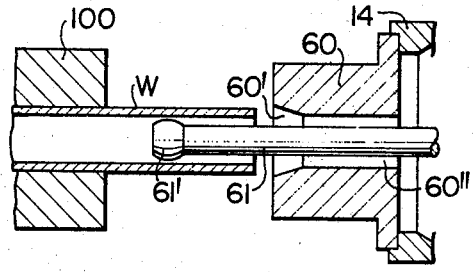
FIGS. 7 to 10 are longitudinal sections showing the various stages of the process of forming a contracted end on a pipe, according to the method of the present invention, using the device of FIG. 6.

Next, with reference to FIGS. 6 to 10, the procedure for performing pipe end processing according to the present invention, using the pipe end processing device shown in FIG. 6, will be described. The first piston member 6 and the second piston member 30 are first withdrawn to the right hand position as seen in the diagram, as shown in FIG. 6. In this state, the work tube W is fitted to the clamp device 100. When the work tube is correctly in position, and correctly aligned, with its axis the same as the axes of the die 60 and the punch 61, hydraulic fluid is supplied to the third pressure chamber 47 through the hydraulic fluid passage 49, and thus the second piston member 30 is driven to the left in the diagram. Then, as shown in FIG. 7, the ironing portion 61′ of the ironing punch 61 is introduced into the open end of the work tube W. When this ironing portion 61′ has reached a position corresponding to the left hand end of the portion of the pipe end which is to be reduced, or leftwards of that position, the supply of hydraulic fluid to the third pressure chamber 47 through the hydraulic fluid passage 49 is stopped, and then hydraulic fluid under pressure is supplied to the first pressure chamber 26 through the hydraulic fluid passage 28, so that the first piston member 6 is moved to the left in the figure. Thereby, as shown in FIG. 8, the guide hole 60′ of the reducing die 60 mates with the end of the work tube W, and guides it, by its taper, into the bore 60″ of the reducing die, so that this bore engages with the outer surface of the work pipe W and, squeezing inwards the end of the pipe as it advances thereover, forms the reduced portion Wr, as seen in FIG. 8.

When the reducing die has been advanced to the desired position, wherein an appropriate length of the pipe has been reduced in diameter, the supply of hydraulic fluid to the first pressure chamber 26 through the hydraulic fluid passage 28 is stopped, and, with the reducing die 60 held as it is, in the position as at the end of the reduction operation as shown in FIG. 8, encasing the tube end Wr, hydraulic fluid is supplied to the fourth pressure chamber 48 through the hydraulic fluid passage 50. Thereby, the second piston member 30 is withdrawn to the right in the diagram, and, as this happens, the ironing portion 61′ of the ironing punch 61 is moved from the left hand end of the reduced portion, through it, towards the open end of the pipe, and, because the outer diameter of this ironing punch 61 is arranged to be a little greater than the inside diameter of the squeezed down portion of the tube end, as explained above, it engages with the inner surface of the reduced portion and performs an ironing operation, by squeezing the reduced portion between itself and the reducing die 60, and thus relieving any stresses that may have been set up in it, and any spring-back effect that may exist therein, by a process of plastic deformation.

Figure 9:
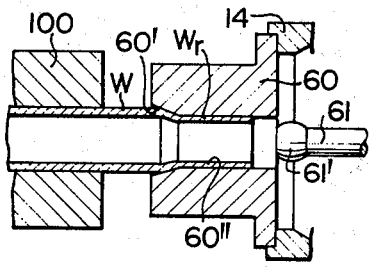
Figure 10:
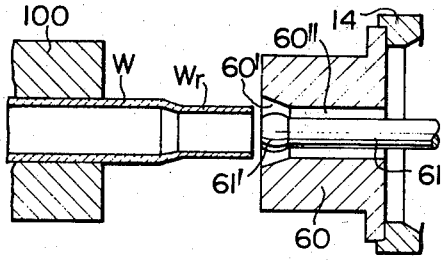

When the ironing portion 61′ of the ironing punch 61 has been separated from the work tube W, as shown in FIG. 9, the supply of hydraulic fluid to the fourth pressure chamber 48 through the hydraulic fluid passage 50 is stopped, and hydraulic fluid is supplied to the second pressure chamber 27 through the hydraulic fluid passage 50, and thus the first piston member 6 is withdrawn to the right in the diagram. Accordingly, the reducing die 60, which was to the left hand end position in the figure, is withdrawn from the work tube W, as shown in FIG. 10.

Thus a work tube W, with a reduced portion Wr formed at its one end, is made. In this case, as with the expanding operation which is described above, the portion which has been altered in diameter is ironed by being squeezed between the die which originally altered its diameter, and an ironing die, and thus it is brought to the final desired dimensions while the stresses set up in it by the original deforming operation, and any springback effect that may exist therein, are removed.

Thereby, pipe ends of reduced, as well as expanded, form of high accuracy can be produced.

Although the present invention has been shown and described with reference to some preferred embodiments thereof, it should be understood that various changes, omissions, and/or alterations of the form and the content of any particular embodiment can be made by one skilled in the art, without departing from the scope of the invention, which it is therefore desired should be defined only by the appended claims, and not by any details of the embodiments shown, or of the drawings, which were given for illustration only.

We claim:

1. A process for altering the diameter uniformly over a certain axial length of an end portion of a cylindrical pipe which has a cylindrical inside surface and a cylindrical outside surface, comprising the steps, in the specified order, of:

(a) applying a diameter modification element having a cylindrical surface of at least said certain axial length to one of said cylindrical surfaces of the pipe over said certain axial length, so as to modify the diameter of said end portion; and (b) maintaining said diameter modification element in the position it assumed at the completion of step (a), and (c) squeezing said diameter-modified end portion of the pipe between said cylindrical surface of said diameter modification element, and an ironing element which is applied to the other said cylindrical surface of the pipe by moving said ironing element axially over said diameter-modified end portion with a clearance between itself and said cylindrical surface of said diameter modification element which is less than the thickness of said diameter-modified end portion.

2. The process for altering the diameter of the end portion of a cylindrical pipe of claim 1, wherein the diameter modification element is a rod form expanding punch which is inserted into the open end portion of the pipe and is applied to the cylindrical inside surface of the pipe over said certain axial length, and the ironing element is an annular ironing die which is applied to the cylindrical outside surface of the pipe over said certain axial length.

3. The process for altering the diameter of the end portion of a cylindrical pipe of claim 1, wherein the diameter modification element is a tube form reducing die which is engaged with the pipe over its open end portion and is applied to the cylindrical outside surface of the pipe over said certain axial length, and the ironing element is a rounded ironing punch which is applied to the cylndrical inside surface of the pipe over said certain axial length.

4. The process for altering the diameter of the end portion of a cylindrical pipe of claim 2, wherein the annular ironing die is put over the end portion of the pipe before the rod form expanding punch is inserted into the open end of the pipe so as to expand it, and wherein said annular ironing die is subsequently pulled off over the expanded end portion of the pipe over said certain axial length so as to iron said expanded end portion against said rod form expanding punch.

5. The process for altering the diameter of the end portion of a cylindrical pipe of claim 3, wherein the circular ironing punch is put into the open end portion of the pipe before the tube form reducing die is applied over the end so as to contract it, and wherein said circular ironing punch is subsequently pulled out through the contracted end portion of the pipe over said certain axial length so as to iron said contracted end portion against said tube form reducing die.

6. A process for reducing the diameter uniformly over a certain axial length of an end portion of a cylindrical pipe which has a cylindrical inside surface and a cylindrical outside surface, comprising the steps, in the specified order, of:

(a) applying a diameter reducing element having a cylindrical surface of at least said certain axial length to said cylindrical outside surface of the pipe over said certain axial length, so as to reduce the diameter of said end portion; and (b) maintaining said diameter reducing element in the position it assumed at the completion of step (a), and (c) squeezing said diameter-reduced end portion of the pipe between said inner cylindrical surface of said diameter reducing element, and an ironing element which is applied to said cylindrical inside surface of the pipe by moving said ironing element axially through said diameter-reduced end portion with a clearance between itself and said inner cylindrical surface of said diameter reducing element which is less than the thickness of said diameter-reduced end portion.

7. A process for increasing the diameter uniformly over a certain axial length of an end portion of a cylindrical pipe which has a cylindrical inside surface and a cylindrical outside surface, comprising the steps, in the specified order, of:

(a) applying a diameter increasing element having a cylindrical surface of at least said certain axial length to said cylindrical inside surface of the pipe over said certain axial length, so as to increase the diameter of said end portion; and (b) maintaining said diameter increasing element in the position it assumed at the completion of step (a), and (c) squeezing said diameter-increased end portion of the pipe between said outer cylindrical surface of said diameter increasing element, and an ironing element which is applied to said cylindrical outside surface of the pipe by moving said ironing element axially over said diameter-increased end portion with a clearance between itself and said outer cylindrical surface of said diameter increasing element which is less than the thickness of said diameter-increased end portion.

* * * * *